US006942527B1

(12) United States Patent
Lias et al.

(10) Patent No.: US 6,942,527 B1
(45) Date of Patent: Sep. 13, 2005

(54) DUAL FUNCTION TERMINAL ASSEMBLY AND ELECTRIC POWER APPARATUS INCORPORATING THE SAME

(75) Inventors: Edward E. Lias, Aliquippa, PA (US); Michael J. Whipple, Rochester, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/782,028

(22) Filed: Feb. 19, 2004

(51) Int. Cl.[7] ..... H01R 4/36

(52) U.S. Cl. ..... 439/814; 335/202

(58) Field of Search ..... 439/812–814, 439/810, 781–782, 174, 166; 335/202

(56) References Cited

U.S. PATENT DOCUMENTS 4,511,204 A 4/1985 Glenn
6,280,264 B1 8/2001 Whipple et al.

*Primary Examiner*—Javaid H. Nasri
(74) *Attorney, Agent, or Firm*—Martin J. Moran

(57) ABSTRACT

A terminal assembly can be alternatively used to make either a pressure plate or screw type connection for connecting stranded wire or solid wire, respectively, to a power conductor of electric power apparatus such as a circuit breaker. An electrically insulative barrier has an elongated member with a lateral extension at one end having a recess that captures the head of the screw of a terminal collar for the pressure plate connection. As the screw is tightened, the collar is drawn toward the power conductor to clamp the stranded wire between the collar and one side of the power conductor. With the elongated member turned end for end, the screw is free to clamp the solid wire against the other side of the power conductor. Pairs of integral compliant latches on the elongated member accommodate quick conversion between the two types of connections.

14 Claims, 3 Drawing Sheets

DUAL FUNCTION TERMINAL ASSEMBLY AND ELECTRIC POWER APPARATUS INCORPORATING THE SAME

BACKGROUND OF THE INVENTION

1. Field of the Invention

This invention relates to terminal assemblies for connecting a power conductor in electrical power apparatus to an external conductor, and particularly to such terminal assemblies that can be selectively applied in the field to provide either a screw binding connection or a pressure plate connection to the external conductor.

2. Background Information

Many types of electrical apparatuses have molded housings with external recesses into which power conductors within the apparatus extend for connection to an external conductor. It is common for the power conductor to be a flat strap of a conductive material such as copper. A terminal connector secures the external conductor to the strap. A common terminal connector comprises a collar having a through hole sized to slide onto the flat strap and through which the external conductor extends along the power conductor. A screw threaded through a transverse bore in the collar clamps the conductor and external conductor together to effect an electrical and mechanical connection.

There are two types of external conductors that are connected to the flat power conductor of electric power apparatus using such a terminal collar, solid wire and stranded wire. Typically, the solid round wire is placed between the flat power conductor and the screw, which is then threaded down to clamp the wire against the flat power conductor. If the same arrangement is used with stranded wire, the screw separates the wires clamping only a few, and breaking some, to make a poor electrical and mechanical connection. To avoid these problems, a pressure plate connection is made for stranded wire instead of the direct contact by the terminal screw. Such a pressure plate connection can be accomplished by attaching a pressure plate to the end of the screw so that the stranded wire is pressed against the flat conductor by an extended contact surface, or the stranded wire is placed on the opposite side of the flat conductor so that tightening the screw draws the collar toward the flat conductor clamping the stranded wire between the power conductor and the collar.

With the presently available terminal assemblies, suppliers and users must maintain an inventory of both types of devices, which is inconvenient and costly. Hence, there is room for improvement.

SUMMARY OF THE INVENTION

In accordance with one aspect of the invention, a dual function terminal assembly is provided, that can be alternatively used to provide a screw binding connection for a solid external wire and a pressure plate connection for stranded wire, thereby eliminating the need for a user to buy and stock two different types of terminals. Thus, in accordance with this aspect of the invention, a terminal assembly for connecting an external conductor to a power conductor of an electrical power apparatus having a molded case forming a terminal cavity into which the power conductor extends, comprises a collar disposed in the terminal cavity and having a through opening through which the power conductor extends and a threaded cross opening transverse to and extending to the through opening. A screw having an enlarged head and a threaded shaft is threaded into the threaded cross opening of the collar. An electrically insulative barrier comprises an elongated member having a transverse hole therethrough sized to accept the external conductor. The elongated member has a lateral extension adjacent to one end defining a recess sized to capture the enlarged head of the screw with the threaded shaft adjacent to the elongated member. A coupling couples the electrically insulative barrier to the molded casing selectively in a first position in the terminal cavity with the transverse hole aligned with the through opening in the collar and with the enlarged head of the screw captured in the recess to, when rotated, axially draw the collar toward the lateral extension on the electrically insulative barrier and clamp the external conductor extending into the through hole opening of the collar through the transverse opening in the elongated member against the first side of the power conductor. The coupling can alternatively couple the barrier to the molded casing in a second position with the screw head out of the recess and free to move axially into the collar and clamp the flexible conductor inserted into the through opening through the transverse opening in the elongated member against a second surface of the power conductor. In a preferred embodiment, the elongated member is rotated end-for-end between the first and second positions. In this embodiment, the elongated member has a midpoint that is aligned with the power conductor in both the first and second positions and the transverse opening in the elongated member is adjacent the midpoint for alignment with the first surface of the power conductor in the first position and with the second surface of the power conductor in the second position. The elongated member can have an indentation at the midpoint for receiving a free end of the power conductor. Also, the elongated member can have a pair of opposed axially facing surfaces forming axial travel limits for the collar. One of these surfaces supports the collar in the second position for inserting the external conductor into the collar. The collar can have a lateral projection that engages each of the axial facing surfaces on the elongated member. The elongated member is oriented to the first position when the external conductor is a stranded conductor to provide the pressure plate connection and is oriented to the second position when the external conductor is a solid wire to provide the screw binding connection.

In accordance with another aspect of the invention, an electric power apparatus has a molded casing forming a terminal cavity, a flat power conductor extending into and terminating in the terminal cavity and a terminal assembly as described above, which can be alternatively oriented in the first and second positions for a stranded external conductor and a solid wire external conductor, respectively. The coupling coupling the electrically insulative barrier to the molded casing of the electric power apparatus can comprise at least one compliant latch and at least two latching surfaces in the molded casing engaged by the at least one compliant latch to secure the elongated member in the first position and the second position. In the preferred embodiment, there are compliant latches at each end of the elongated member which engage common latch surfaces from the molded casings in the first and second positions of the elongated member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
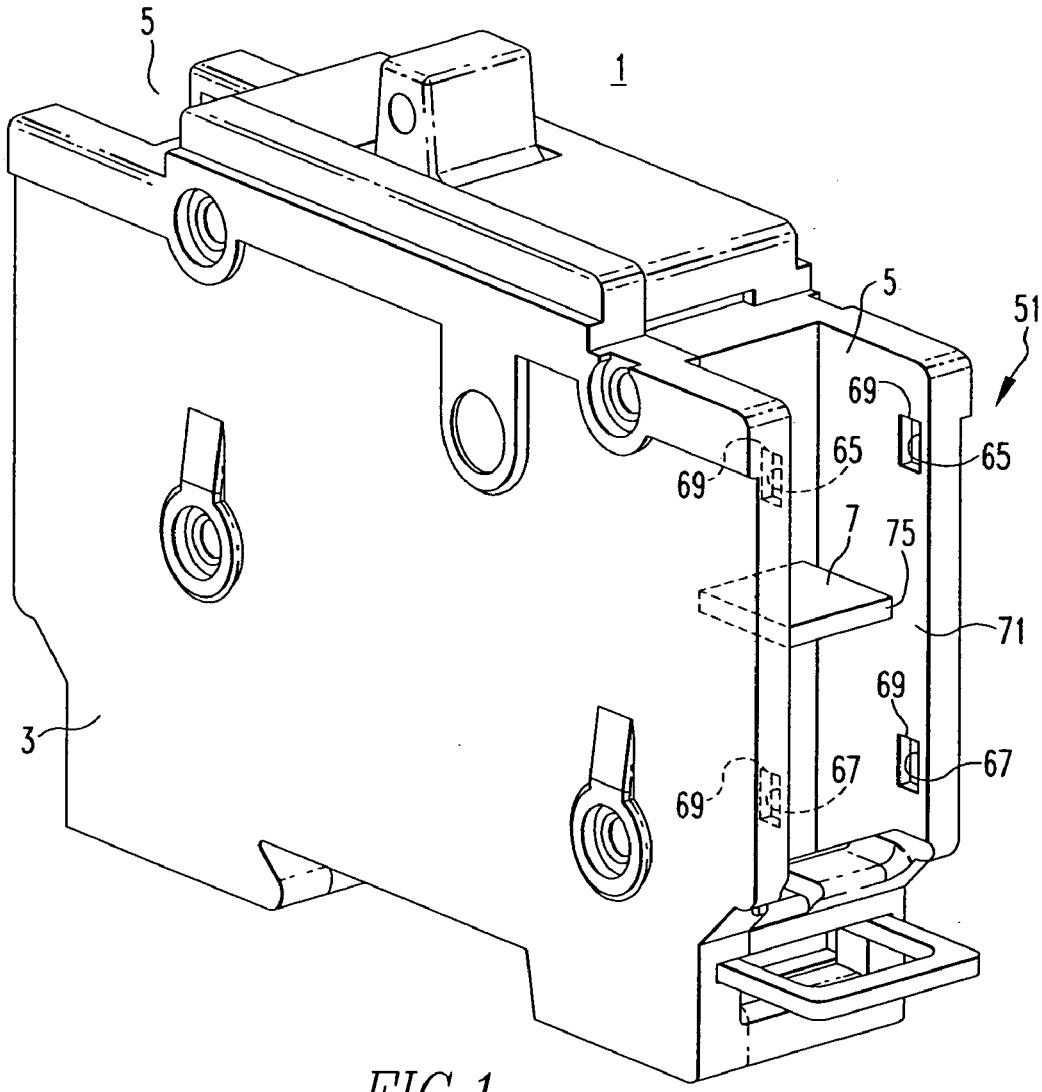
FIG. 1 is an isometric view of an electric power apparatus in the form of a circuit breaker adapted to incorporate the invention.

The invention will be described as applied to an electric power apparatus such as the single pole circuit breaker 1 illustrated in FIG. 1; however, it will become apparent that the invention can be readily applied to other types of electrical power apparatuses. This circuit breaker 1 has a molded casing 3 that incorporates terminal cavities 5 at each end into which power conductors 7, typically formed as a flat strap, extend (see also FIG. 3).

Figure 3:
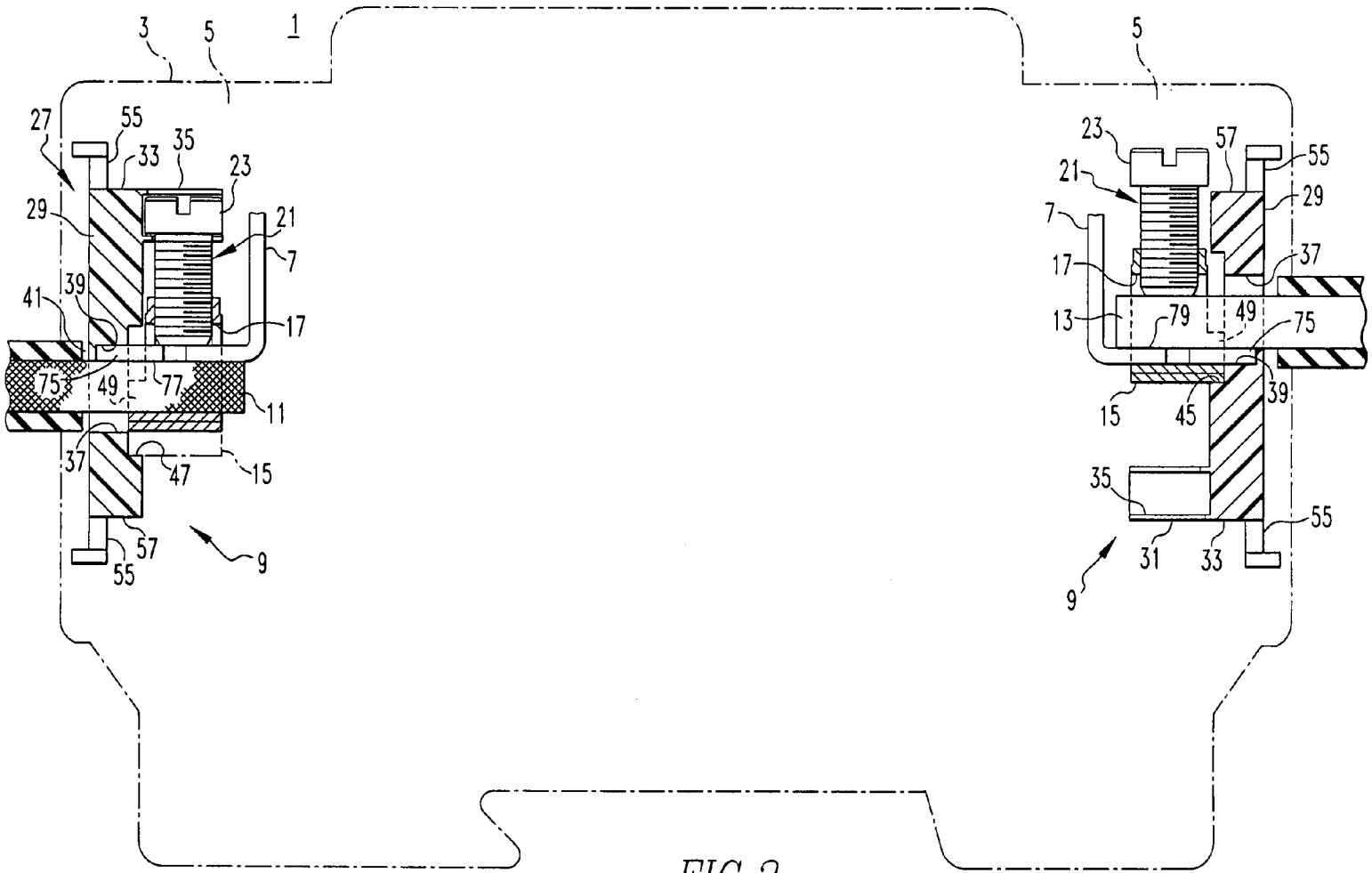
FIG. 3 is a vertical sectional view through a schematically shown circuit breaker illustrating on the left side a preferred form of the terminal assembly oriented to secure a stranded external wire to a power conductor in the circuit breaker and illustrating on the right side this preferred form of the terminal assembly oriented to secure a solid round wire to a circuit breaker power conductor.

A feature of the invention is a terminal assembly 9 that interchangeably provides a pressure plate connection or a screw connection for connecting the power conductors 7 to external wiring that can be either a stranded wire 11 or a solid wire 13, as shown in FIG. 3.

Figure 2:
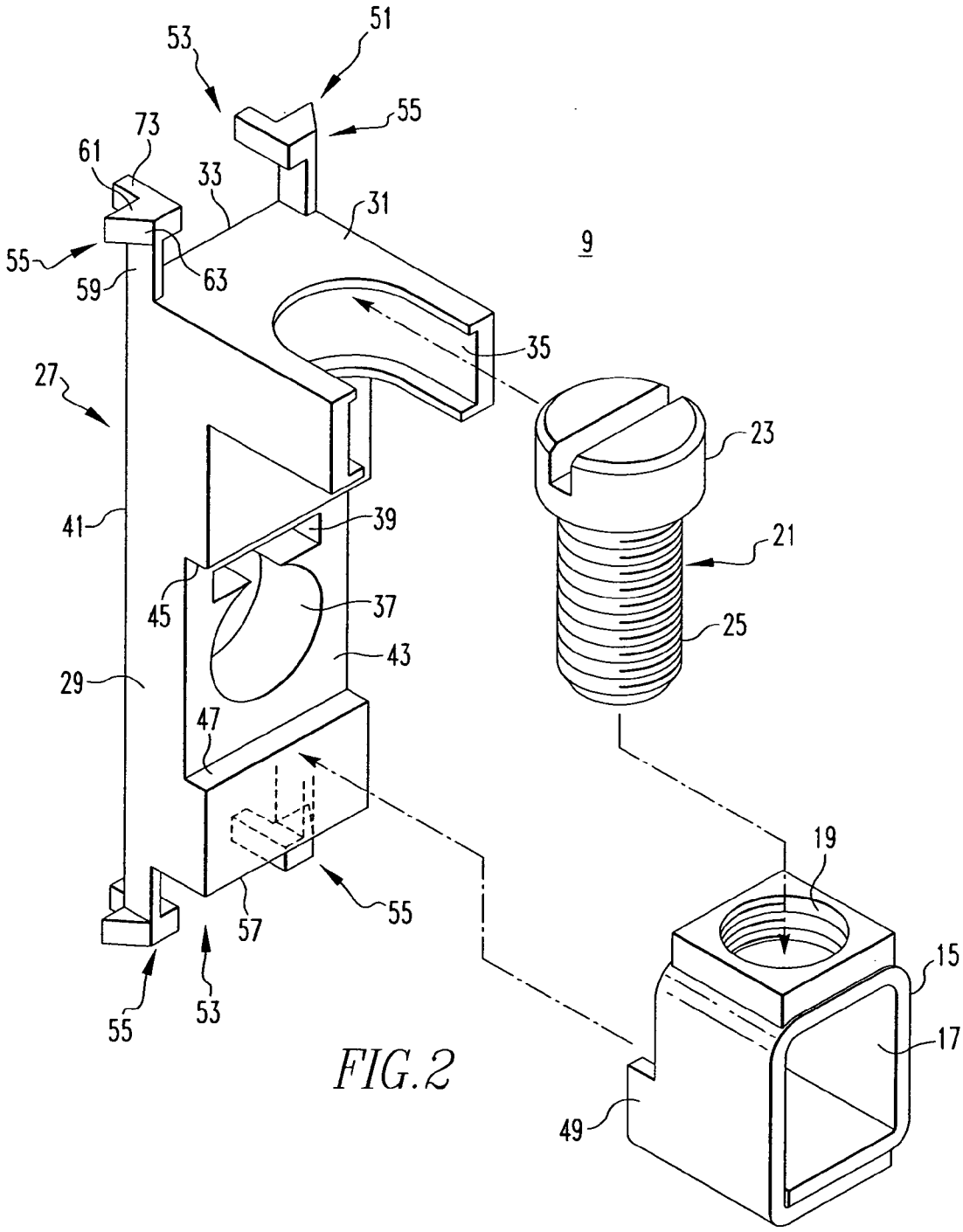
FIG. 2 is an exploded isometric view of a preferred embodiment of the terminal assembly.

Turning to FIG. 2, the terminal assembly 9 includes a collar 15 having a through opening 17 and a threaded cross opening 19 transverse to and extending to the through opening 17. A screw 21 having an enlarged head 23 and a threaded shaft 25 that screws into the threaded opening 19 is also part of the terminal assembly 9. The terminal assembly 9 further includes an electrically insulative barrier 27 molded as an elongated member 29 with a lateral extension 31 at one end 33. The lateral extension 31 has a recess 35 sized to capture the enlarged head 23 of the screw 21. As will be seen, when the head 23 of the screw 21 is captured in the recess 35, the threaded shaft 25 extends adjacent the elongated member 29. In one alternative arrangement, the recess can be a counter bored hole through the extension 31 parallel to the elongated member 29. The elongated member 29 also has a transverse through hole 37 and an indentation 39 that intersects the transverse hole 37 but only extends partway through the elongated member. As will be seen, this indentation 39 is sized to receive a power conductor 7. The indentation 39 is aligned with the axial midpoint 41 of the elongated member 29. The inner face 43 of the elongated member 29 sets back above and below the transverse hole 37 and indentation 39 to form a pair of opposed axially facing surfaces 45 and 47. The collar 15 has a lateral projection 49 which can alternatively seat on these surfaces 45 and 47.

The terminal assembly 9 is coupled to the circuit breaker in the terminal cavity 5 in alternate positions by a coupling 51. This coupling 51 includes pairs 53 of compliant latches 55 at the one end 33 of the elongated member 29 and at the other end 57. Each compliant latch 55 is formed by an integral extension 59 on the molded elongated member 29 and a laterally extending latch member 61 having a beveled face 63. The latch members 61 engage either an upper pair of latch surfaces 65 or lower pair of latch surfaces 67 formed in latch recesses 69 molded in the sidewalls 71 of the terminal cavities 5. As the barrier 27 is pushed into one of the terminal cavities 5, the beveled surfaces 63 deflect the compliant latches laterally inward until the latch members 61 snap into the latch recesses 69. The compliant latches 55 have integral outwardly extending fingers 73 so that each pair 53 can be squeezed together to release the latch members 61 from the recesses 69 for removal of the terminal assembly 9.

FIG. 3 shows on the left side orientation of the terminal assembly 9 for making a pressure plate connection for connecting the stranded wire 11 to the power conductor 7 and on the right side use of the terminal assembly 9 for making a screw connection for securing the solid wire 13 to the power conductor 7.

For the pressure plate connection shown on the left side of FIG. 3, the elongated member 29 is oriented with the one end 33 upward so that the lateral extension 31 is at the top as also shown in FIG. 2. The head 23 of the screw 21 is seated in the recess 35 of the extension 31. The collar 15 is threaded onto the threaded shaft 25 and may be seated on the axially facing surface 47 so that the screw opening 17 of the collar is fully aligned with the transverse hole 37 in the elongated member 29. It is not necessary that the collar be seated on this ledge; however, this permits the largest size stranded wire that can be accommodated to be inserted into the collar. In any event, the terminal assembly is then pushed into the terminal cavity 5 so that the free end 75 of the power conductor 7 seats in the indentation 39 in the elongated member as the compliant latches 55 engage the latch surfaces 65 and 67 to lock the terminal assembly in place. The stranded wire is then inserted through the transverse hole 37 in the elongated member 29 and through the through opening 17 in the collar 15. A screwdriver (not shown) or other tool can then engage and rotate the screw 21, which being captured in the recess 35 draws the collar 15 upward clamping the stranded wire 11 between the collar and the first or lower surface 77 of the power conductor 7.

For connecting a solid wire 13 to a power conductor 7, the elongated member 29 is oriented as shown in the right side of FIG. 3 with the one end 33 facing downward. In this arrangement, the collar 15 remains in the same orientation with the screw 21 extending upward and therefore free of the recess 35. The collar 15 seats at the lower end on the first axially facing surface 45, so that when the terminal assembly slides onto the power conductor 7, which seats in the indentation 39, the through opening 17 is fully aligned with the transverse hole 37 in the elongated member 29 for receiving the largest diameter solid wire 13 that can be accommodated. Again, the compliant latches 55 secure the terminal assembly in the terminal cavity 5 by engaging the latch surfaces 65 and 67. To make a connection, the solid wire is passed through the transverse hole 37 into the through opening 17 of the collar 15 and then the screw 21 is tightened down to clamp the solid wire 13 between the screw and the second or upper surface 79 of the power conductor 7.

While the orientation of the terminal assembly 9 is shown for the pressure plate connection on the left side of FIG. 3 and the orientation for the screw type connection shown on the right side, either of these terminal assemblies 9 can be used for either type of connection. Thus, the terminal assembly 9 on the left side can be removed by squeezing the pairs 53 of compliant latches 55 together using the fingers 73 and sliding the terminal assembly off of the power conductor 7. The screw head 23 is then removed from the recess 35 and the elongated member is turned end for end so that the one end 33 is facing downward. The terminal assembly can then be assembled as a screw-type connection as shown on the right side of FIG. 3. Similarly, the terminal assembly 9 on the right side can be removed, the elongated member 29 turned end to end, the screw head 23 inserted in the recess 35 and the assembly then snapped back into the terminal cavity 5 on the right side as a pressure plate connection. In either orientation, the molded, electrically insulative elongated member 29 provides a barrier which protects users from contact with electrically energized components.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A terminal assembly for connecting an external conductor to a power conductor of an electric power apparatus having a molded case forming a terminal cavity into which the power conductor extends, the terminal assembly comprising:

a collar disposed in the terminal cavity and having a through opening through which the power conductor extends and a threaded cross opening transverse to and extending to the through opening;

a screw having an enlarged head and a threaded shaft threaded into the threaded cross opening for extension into the through opening of the collar;

an electrically insulative barrier comprising an elongated member having a transverse hole therethrough sized to accept the external conductor, and a lateral extension adjacent one end of the elongated member defining a recess sized to capture the enlarged head of the screw with the threaded shaft adjacent to the elongated member; and a coupling coupling the electrically insulative barrier to the molded casing selectively in a first position in the terminal cavity with the transverse hole aligned with the through opening in the collar and with the enlarged head of the screw captured in the recess to, when rotated, axially draw the collar toward the lateral extension on the electrically insulative barrier and clamp the external conductor extending into the through opening of the collar through the transverse opening in the elongated member against a first side of the power conductor, and a second position with the enlarged head of the screw out of the recess and free to, when rotated, move axially into the collar and clamp the external conductor inserted into the through opening through the transverse opening in the elongated member against a second surface of the power conductor.

2. The terminal assembly of claim 1 wherein the elongated member is rotated end-for-end between the first position and the second position.

3. The terminal assembly of claim 2 wherein the elongated member has a midpoint that is aligned with the power conductor in both the first position and the second position and the transverse opening in the elongated member is adjacent the midpoint for alignment with the first surface of the power conductor in the first position and is aligned with the second surface of the power conductor in the second position of the elongated member.

4. The terminal assembly of claim 3 wherein the elongated member has an indentation at the midpoint receiving a free end of the power conductor.

5. The terminal assembly of claim 3 wherein the elongated member has a pair of opposed axially facing surfaces forming axial travel limits for the collar.

6. The terminal assembly of claim 5 wherein the collar has a lateral projection that can alternatively engage each of the axially facing surfaces on the elongated member.

7. The terminal assembly of claim 1 wherein the elongated member has a first axially facing surface supporting the collar in the second position of the elongated member for insertion of the external conductor through the transverse hole through the elongated member and into the collar.

8. The terminal assembly of claim 1 wherein the elongated member is oriented to the first position when the external conductor is a stranded conductor, and is oriented to the second position when the external conductor is a solid wire.

9. An electric power apparatus comprising:

a molded casing having a terminal cavity;

a power conductor extending into and terminating in the terminal cavity; and a terminal assembly comprising:

a collar disposed in the terminal cavity and having a through opening through which the power conductor extends and a threaded cross opening transverse to and extending to the through opening;

a screw having an enlarged head and a threaded shaft threaded into the threaded cross opening of the collar;

an electrically insulative barrier comprising an elongated member having a transverse hole therethrough sized to accept an external conductor, and a lateral extension adjacent one end of the elongated member defining a recess sized to capture the enlarged head of the screw with the threaded shaft adjacent to the elongated member; and a coupling coupling the electrically insulative barrier to the molded casing selectively in a first position in the terminal cavity with the transverse hole aligned with the through opening in the collar and with the enlarged head of the screw captured in the recess to, when rotated, axially draw the collar toward the lateral extension on the electrically insulative barrier and clamp the external conductor extending into the through opening of the collar through the transverse opening of the elongated member against a first side of the power conductor, and a second position with the elongated member rotated end-for-end from the first position with the enlarged head of the screw out of the recess and free to, when rotated, move axially into the collar and clamp the external conductor inserted into the through opening through the transverse opening in the elongated member against a second surface of the power conductor.

10. The electrical power apparatus of claim 9 wherein the coupling comprises at least one compliant latch on the elongated member and at least two latch surfaces in the molded casing engaged by the at least one compliant latch alternatively in the first and second positions of the elongated member.

11. The electric power apparatus of claim 10 wherein the elongated member has a midpoint aligned with the power conductor in both the first position and the second position of the elongated member.

12. The electric power apparatus of claim 11 wherein complaint latches are positioned on each end of the elongated member and the latch surfaces are positioned on the casing such that the latch surfaces are common for the compliant latches in the first position and the second position of the elongated member.

13. The electric power apparatus of claim 12 wherein the elongated member has a pair of opposed axially facing surfaces forming axial travel limits for the collar and the collar has a lateral projection that can alternatively engage each of the axially facing surfaces.

14. The electric power apparatus of claim 9 wherein the elongated member is oriented to the first position when the external conductor is a stranded conductor and is oriented to the second position when the external conductor is a solid wire.

* * * * *